US006979067B2

(12) United States Patent
Yang

(10) Patent No.: US 6,979,067 B2
(45) Date of Patent: Dec. 27, 2005

(54) CAM LOCK WITH TORSION SPRING FOR A DRAWER SLIDE

(75) Inventor: Wenming Yang, Singapore (SG)

(73) Assignee: Central Industrial Supply Company, Grand Prairie, TX (US)

( * ) Notice: Subject to any disclaimer, the term of this patent is extended or adjusted under 35 U.S.C. 154(b) by 0 days.

(21) Appl. No.: 10/857,129

(22) Filed: May 28, 2004

(65) Prior Publication Data

US 2004/0239221 A1 Dec. 2, 2004

Related U.S. Application Data

(60) Provisional application No. 60/474,882, filed on May 30, 2003.

(51) Int. Cl.[7] ..... A47B 88/04
(52) U.S. Cl. ..... 312/334.46; 312/333
(58) Field of Search ..... 312/330.1, 334.1, 312/334.7, 334.8, 334.44, 334.46, 334.47, 312/334.9, 319.1, 319.2, 333; 384/20, 21

(56) References Cited

U.S. PATENT DOCUMENTS

| | | | | |
|---|---|---|---|---|
| 1,071,006 A | | 8/1913 | Little | |
| 2,862,772 A | * | 12/1958 | Gussack | 384/19 |
| 3,860,308 A | * | 1/1975 | Burke | 312/334.9 |
| 4,441,772 A | * | 4/1984 | Fielding et al. | 312/330.1 |
| 4,560,212 A | * | 12/1985 | Papp et al. | 384/18 |
| 4,872,734 A | | 10/1989 | Rechberg | |
| 5,405,195 A | | 4/1995 | Hobbs | |
| 5,417,490 A | | 5/1995 | Hobbs et al. | |
| 5,577,821 A | | 11/1996 | Chu | |
| 5,757,109 A | | 5/1998 | Parvin | |
| 5,951,132 A | | 9/1999 | Cirocco | |
| 6,220,683 B1 | | 4/2001 | Chu | |
| 6,296,338 B1 | | 10/2001 | Stijns | |
| 6,367,899 B1 | | 4/2002 | Hwang et al. | |
| 6,655,763 B2 | | 12/2003 | Judge et al. | |
| 6,805,418 B2 | | 10/2004 | Milligan | |
| 2005/0116594 A1 | | 6/2005 | Barry et al. | |

* cited by examiner

*Primary Examiner*—James O. Hansen
(74) *Attorney, Agent, or Firm*—Mark W. Handley; Chauza & Handley, L.L.P.

(57) ABSTRACT

A drawer slide (12) has a chassis member (14), an intermediate member (16) and a rack member (18). An emboss (162) is formed into the rack member (18). A lock member (158) has a tab (160) which extends through a window (164) in the intermediate member (16) for engaging the emboss (162). A slot (166) is formed into the lock member (158) for receiving a fastener (168) to slidably secure the lock member (158) to the intermediate member (16). The slot (166) and the window (164) are configured for receiving the fastener (168) and the tab (160), respectively, such that the lock member (158) is lineally moveable relative to the intermediate member (16). A torsion spring (172) biases the lock member (158) to engage the emboss (162). The chassis member (14) is moved rearward and engages the lock member (158) to move the tab (160) aside of the emboss (162).

20 Claims, 9 Drawing Sheets

CAM LOCK WITH TORSION SPRING FOR A DRAWER SLIDE

CROSS-REFERENCE TO RELATED APPLICATION

The present application claims priority as a continuation-in-part to U.S. Provisional Patent Ser. No. 60/474,882, filed May 30, 2003, entitled Low Profile Front Release For A Friction Slide, and invented by Wenming Yang, a resident of Singapore, in the Republic of Singapore, and a citizen of the Republic of Singapore.

TECHNICAL FIELD OF THE INVENTION

The present invention relates in general to drawer slides, and in particular to locks for drawer slides.

BACKGROUND OF THE INVENTION

Prior art drawer slides have been used for moveably securing a chassis, such as a drawer, to various types of cabinets, such as equipment racks and the like. The drawer slides have been provided by elongate members having formed edges which are nested together in sliding engagement for telescopically moving between extended and retracted positions. The drawer slides are typically mounted within a cabinet in a spaced apart alignment for securing to opposites sides of a chassis, such that the chassis is moveable outward of the cabinet in a cantilevered support arrangement. Various drawer slide locks have been provided for securing the drawer slides in the extended positions, both to prevent the chassis from being pushed back into the cabinet and to prevent inadvertent disassembly of the drawer slides. Some prior art drawer slides have included locks which are released by pushing a user's finger directly against a locking member to release the slides for moving a chassis move back into a cabinet, and to release the slides to allow the chassis to be disassembled from the cabinet. Other prior art drawer slide locks which are released by moving slide members or release members into a lock member, such that the lock member is displaced to allow the drawer slides to be moved from extended positions.

SUMMARY OF THE INVENTION

A cam lock having a torsion spring is disclosed for a drawer slide of the type having a chassis member, an intermediate member and a rack member. The rear lock includes an emboss formed into the rack member to extend from the rack member toward the intermediate member. A lock member is slidably mounted to the intermediate member for moving lineally upwards and downwards relative to the intermediate member. The lock member has a tab formed to extend transverse to a longitudinal axis of the drawer slide. A window is formed into a web portion of the intermediate member for receiving the tab, such that the tab protrudes through the web portion of the intermediate member for engaging the emboss which extends from the rack member. A torsion spring is secured to the intermediate member and engages the lock member to move the lock member into a first position, disposed for engaging the emboss when the intermediate member is disposed in a forward position. The chassis member has a profile which, when the chassis member is moved rearward relative to the intermediate member, engages the lock member to lineally move the lock member to a second position, with the tab disposed aside of the emboss.

A cam lock having a forward release is also disclosed for use as a front lock for a drawer slide. The cam lock with forward release includes a catch aperture formed into the web portion of the intermediate member. A front lock member is provided by a leaf spring having three portions. A first portion of the front lock member is secured to the chassis member. A second portion of the front lock member extends from the first portion, away from the chassis member and toward the intermediate member, and into the catch aperture. A third portion of the front lock member extends from the second portion, away from the intermediate member and toward the chassis member. A front release member is slidably secured to the chassis member. The front release member has a release member window and a cam portion. The release member window is disposed for receiving the third portion of the front lock member and the cam portion is disposed adjacent to the front release member window for pulling in a first direction to engage the third portion of the front lock member and withdraw the second portion of the front lock member from within the catch aperture.

DESCRIPTION OF THE DRAWINGS

For a more complete understanding of the present invention and the advantages thereof, reference is now made to the following description taken in conjunction with the accompanying Drawings in which

FIG. 1 is a perspective view of a drawer slide made according to the present invention;

FIG. 2 is sectional view of the drawer slide, taken along Section Line 2—2 of FIG. 1;

FIG. 3 is partial perspective view of a front portion of an outward side of the drawer slide, showing a front lock;

FIG. 4 is an enlarged view of the front portion of the drawer slide having the front lock, showing an intermediate slide member in phantom;

FIG. 5 is an exploded view of the front portion of the drawer slide, showing the various components of the front lock;

FIG. 6 is a perspective view of a lock member of the front lock;

FIG. 7 is a sectional view of the lock member of the front lock, taken along Section Line 7—7 of FIG. 6;

FIG. 8 is a partial longitudinal section view of the front release member for the front lock;

FIG. 9 is partial longitudinal section view of a chassis member of the slide;

FIG. 10 is a partial longitudinal section view of the front portion of the slide showing the front lock in a locked position;

FIG. 11 is a partial longitudinal section view of the front portion of the slide showing the front lock in a released position;

FIG. 12 is partial perspective view of a rear lock of the drawer slide, showing the rear lock in a locked position;

FIG. 13 is partial perspective view of the rear lock of the drawer slide, showing the rear lock in a released position;

FIG. 14 is a partial exploded view of a rear portion of the drawer slide, showing the various components of the rear lock;

FIG. 15 is a partial side view of a rack member of the drawer slide, showing an embossed portion of the rack member which is part of the rear lock;

FIG. 16 is perspective view of a lock member of the rear lock; and

FIG. 17 is a perspective view of a torsion spring for the rear lock.

DETAILED DESCRIPTION OF THE INVENTION

Figure 1:
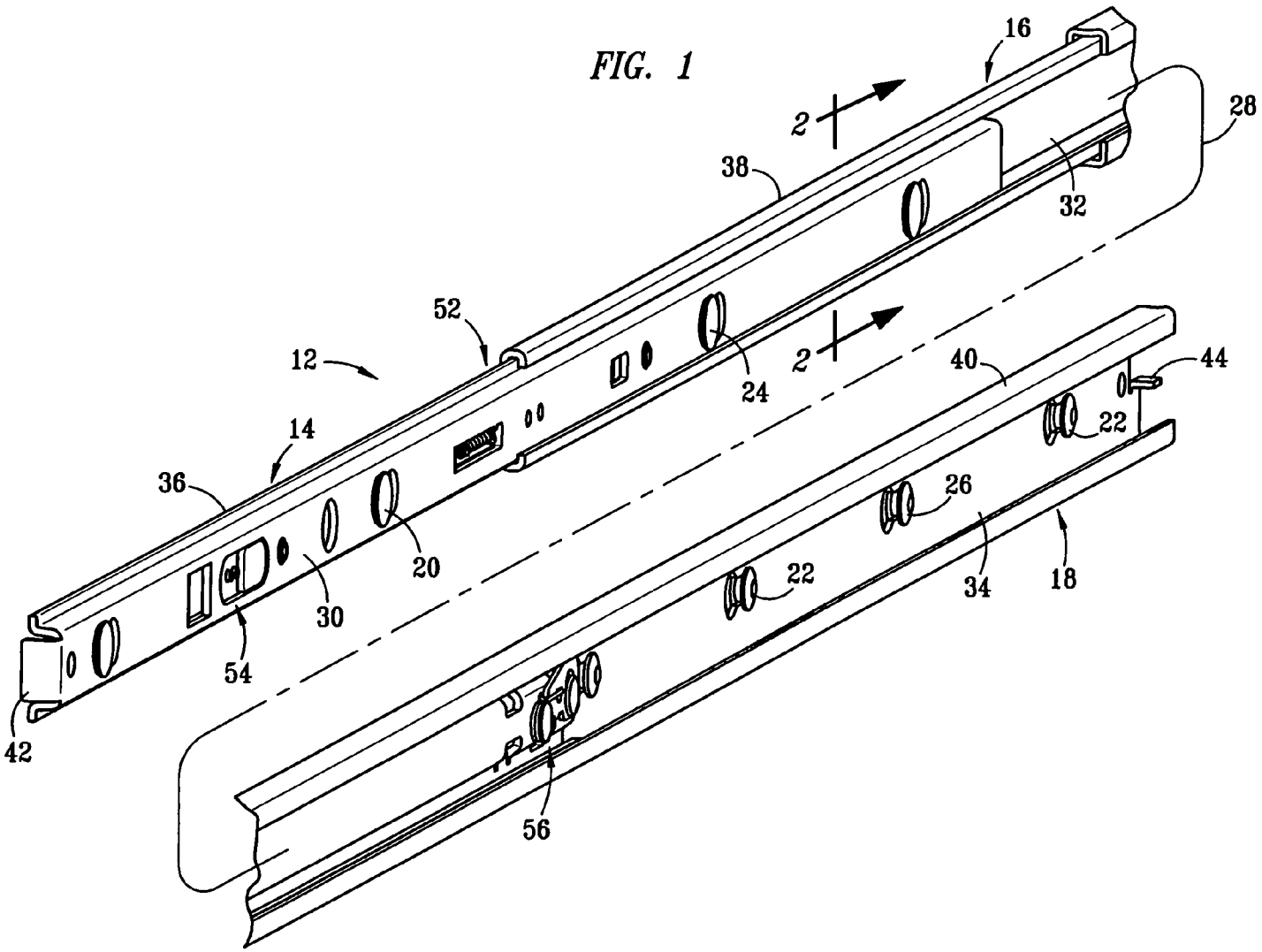
FIGS. 1 through 17 show various aspects of locks for drawer slides made according to the present invention, as set forth below.

Referring to the Figures, FIG. 1 is a perspective view of a drawer slide 12 made according to the present invention. The drawer slide 12 has a chassis member 14, an intermediate member 16 and a rack member 18, which are elongate members having formed edges. The edges of the chassis member 14, the intermediate member 16 and the rack member 18 are slidably secured together in a nested arrangement, such that the drawer slide 12 is telescopically extensible for moving between retracted and extended positions. The chassis member 14 has mounting holes 20 for receiving mounting fasteners 24 for securing the chassis member 14 to a chassis. The rack member 18 has mounting holes 22 for receiving mounting fasteners 26 for securing the rack member 18 to a cabinet, such as an equipment rack, or the like. The drawer slide 12 has a centrally disposed, longitudinal axis 28 along which the chassis member 14 and the intermediate member 16 are slidably moveable relative to the rack member 18. A forward stop tab 42 is provided on the forward end of the chassis member 14, and a rearward stop tab 44 is provided on the rearward end of the rack member 18. A front lock 52 releasably secures the chassis member 14 in an extended position relative to the intermediate member 16. A front release 54 is provided for selectively releasing the front lock 52. A rear lock 56 is provided for releasably securing the intermediate member 16 in a forward position, extended forward of the rack member 18.

Figure 2:
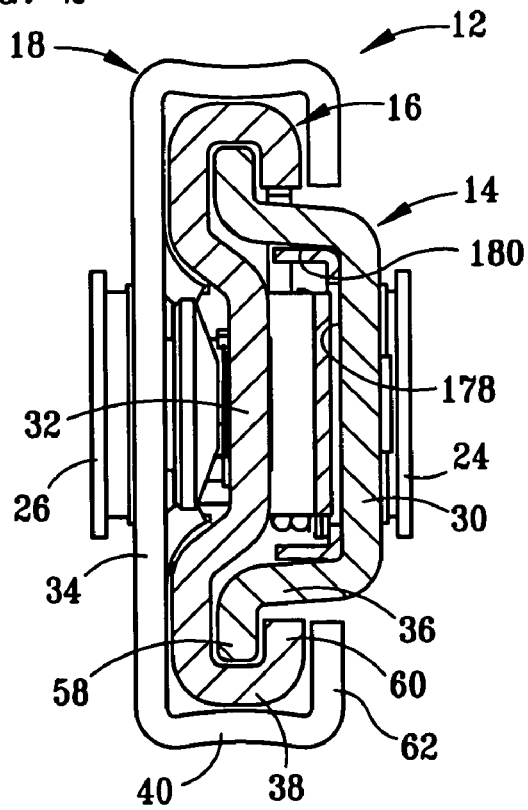

FIG. 2 is a sectional view of drawer slide 12, taken along Section Line 2—2 of FIG. 1. The chassis member 14, the intermediate member 16 and the rack member 18 are elongate members, which are formed as channel type rails having longitudinal axes which extend along a common longitudinal axis 28. The chassis member 14, the intermediate member 16 and the rack member 18 have centrally disposed web portions 30, 32 and 34, respectively, and formed edges 36, 38 and 40, respectively. The web portions 30, 32 and 34 are preferably substantially flat and extend along the longitudinal axis 28 (shown in FIG. 1). The formed edges 36, 38 and 40 fit in a slidably engaged, nested arrangement, such that the edges 36 disposed on opposite sides of the chassis member 14 fit within the edges 38 disposed on opposite sides of the intermediate member 16, and the edges 38 of the intermediate member 16 fit within edges 40 disposed on opposite sides of the cabinet member 18. The formed edges 36, 38 and 40 of the chassis member 14, the intermediate member 16, and the rack member 18 have end tips 58, 60 and 62, respectively. The end tips 58 of the formed edges 56 extend outward relative to the web portion 30 of the chassis member 14, away from the web portion 30 and the longitudinal axis 28. The end tips 60 and 62 of respective ones of the intermediate member 16 and the rack member 18 extend inward relative to respective ones of the formed edges 38 and 40, toward the web portions 32 and 34. The end tips 58 of the formed edges 36 of opposites sides of the chassis member 14 are slidably engaged and captured on three sides by the formed edges 38 of the intermediate member 16, with the end tips 60 of the formed edges 38 extending around the outward edges of respective ones of the end tips 58. The end tips 62 of the formed edges 40 of opposite sides of the chassis rack member 18 are formed to capture the formed edges 38 of the intermediate member 16, each extending on three sides of a respective one of the formed edges 38 to slidably secure the intermediate member 16 within the cabinet member 18. The mounting fasteners 24 and 26 are provided for mounting respective ones of the chassis member 14 to a chassis and the rack member 18 to a cabinet.

Figure 3:
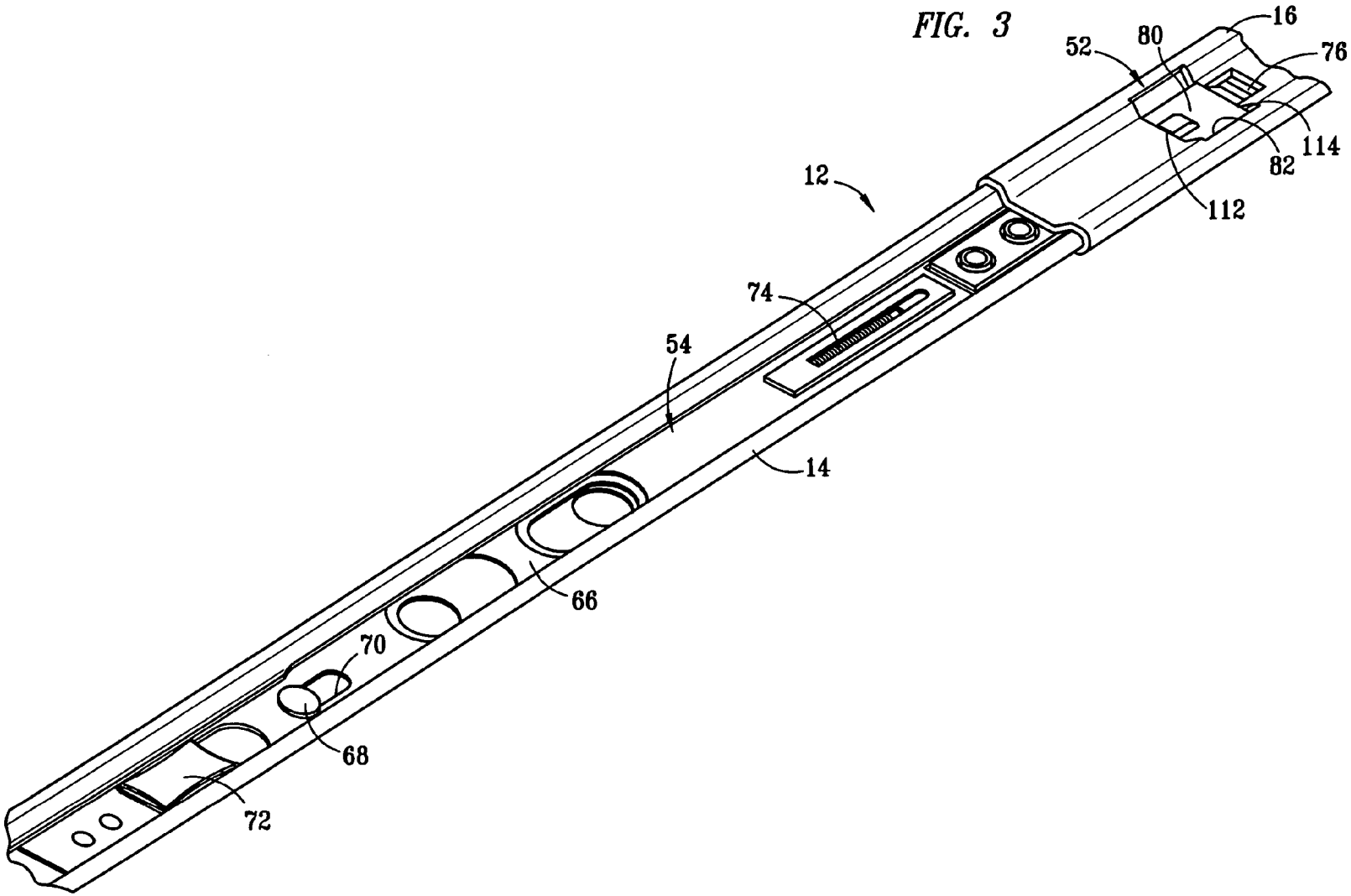
Figure 4:
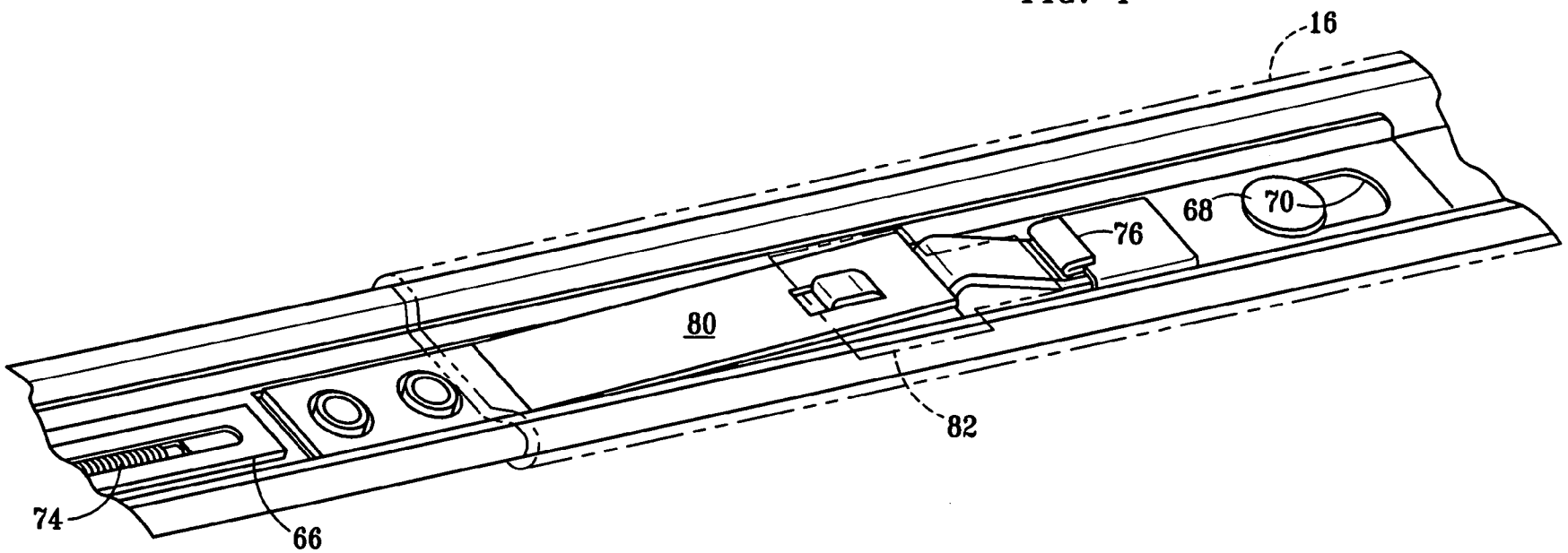

FIGS. 3 and 4 are partial perspective views of a front portion of an outward side of the drawer slide 12, with FIG. 3 showing the front lock 52 and the front release 54, and FIG. 4 showing the intermediate slide member 16 in phantom to show the front lock 52 in more detail. The front release 54 includes an elongated front release member 66 which is slidably secured to the inward side of the chassis member 14 by fasteners 68 (one shown). The front release member 66 has two elongated slots 70 through which the fasteners 68 extend to slidably secure the front release member 66 to the chassis member 14. (See also FIG. 5). A grip tab 72 is mounted to the forward end of the front release member 66. A bias spring 74 provides a biasing means for urging the front release member 66 into a rearwardly disposed position relative to the chassis member 14. An aperture 82 provides a window which extends through a forward portion of the intermediate member 16, with the edges of the aperture 82 providing a catch which is engaged by edges 112 and 114 of the lock member 80 to secure the chassis member 14 in a forwardly extended position relative to the intermediate member 16. The front release member 66 has a cam portion 76 which moves forward when the front release member 66 is pulled forward, pushes against the lock member 80 and moves the lock member 80 downward and from within the aperture 82 of the intermediate member 16.

Figure 5:
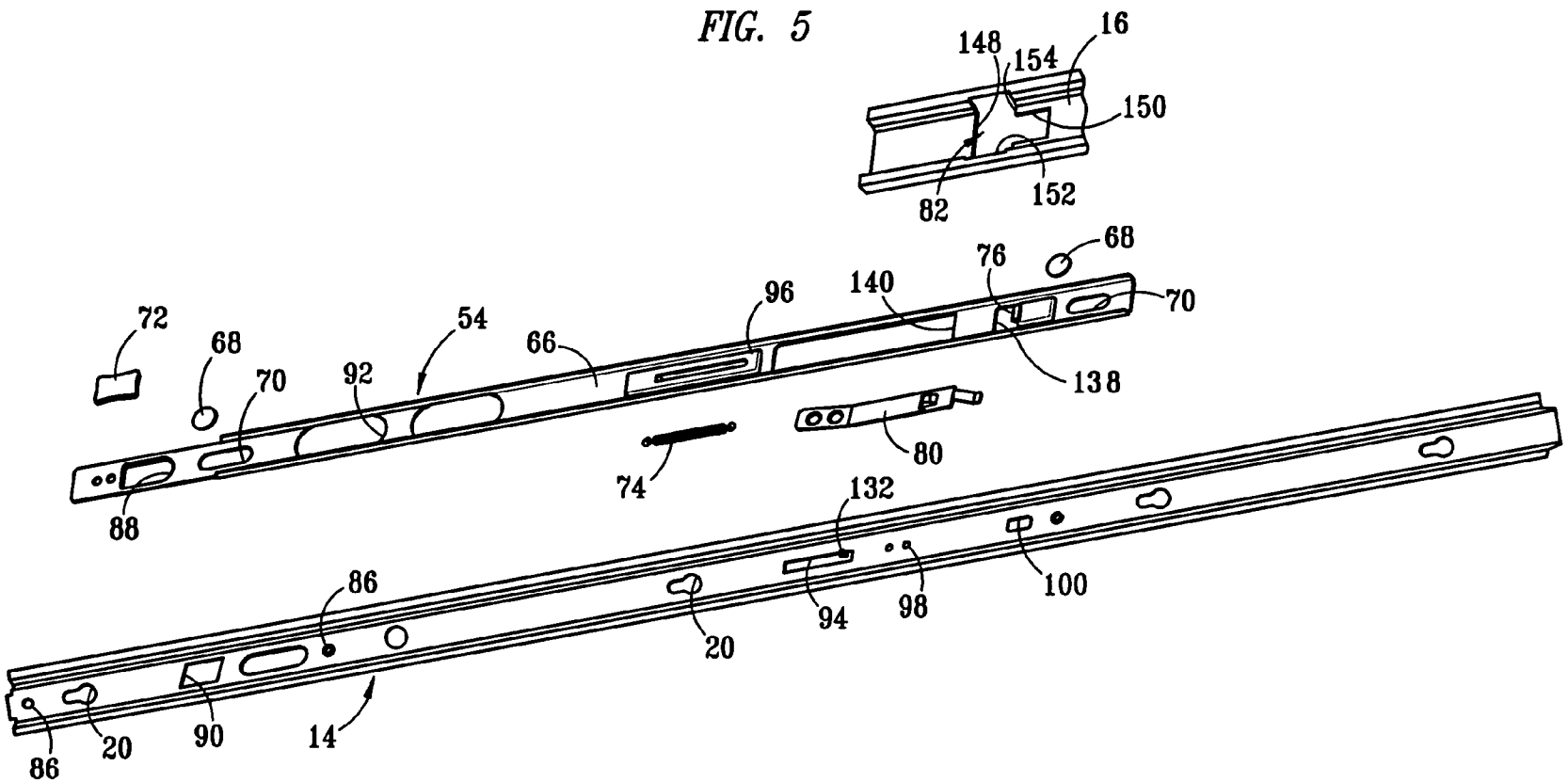

FIG. 5 is an exploded view of the front portion of the drawer slide 12, showing various components of the front lock 52. Apertures 86 are provided in the web portion 30 of the chassis member 14 for securing the fasteners 68 thereto to slidably secure the member 66 of the front release 54 to the chassis member 14. The fasteners 68 may be threadably secured to clench nuts mounted to the holes 86, or fasteners 68 may be rivets, or other suitable fasteners. An aperture 88 extends through a forward end of the front release member 66 for receiving the grip tab 72. An aperture 90 extends through a forward portion of the chassis member 14 for passing the grip tab 72. Apertures 92 are provided for passing the chassis fasteners 24 (shown in FIGS. 1 and 2). An elongated slot 94 is provided in the chassis member 14 for receiving a side of the bias spring 74. An embossed portion 96 of the front release member 66 is formed to provide a housing for the bias spring 74. Mounting holes 98 are provided for mounting the front lock member 80 to the chassis member 14 in a fixedly secured position. The lock member 80 is formed of spring steel, such that it is angularly movable about the mounting holes 98 allowing the lock member 80 to releasably engage within the aperture 82 of the forward end of the intermediate member 16. The rearward end of the front release member 66 has a window 138 through which the lock member 80 extends. An edge of the window 138 defines a cam portion 76 of the front release member 66. Preferably, the cam portion 76 is formed by folding over a thickness of the metal sheet of which the front release member 66 is formed.

A window 100 is formed through the web portion 30 of the chassis member 14 for passing a tab 106 of the lock member 80. The forward end portion of the intermediate member 16 has the aperture 82. The aperture 82 preferably includes an enlarged portion 152 and an adjacent narrower portion 150. The enlarged portion 152 is preferably provided by a rectangular shaped hole disposed forward of the narrower portion 150, which is preferably provided by a hole which is narrower than the enlarged portion 152 across the width of the web portion 32 of the intermediate member 16, defining two forward facing edges 154 of the enlarged portion 152 on opposite sides of the narrower portion 152. The main body 104 of the lock member 80 fits within the enlarged portion 152 of the aperture 82, and the tab 106 will extend downward and through the narrow portion 150 of the aperture 82. The rearward facing edge 114 of the lock member 80 will engage the two rearwardly disposed, forward facing edges 154 of the aperture 82. (See also FIG. 6). A forwardly disposed, rearward facing edge 148 of the aperture 82 will engage the shoulder 112 of the emboss 110 of the lock member 80.

Figure 6:
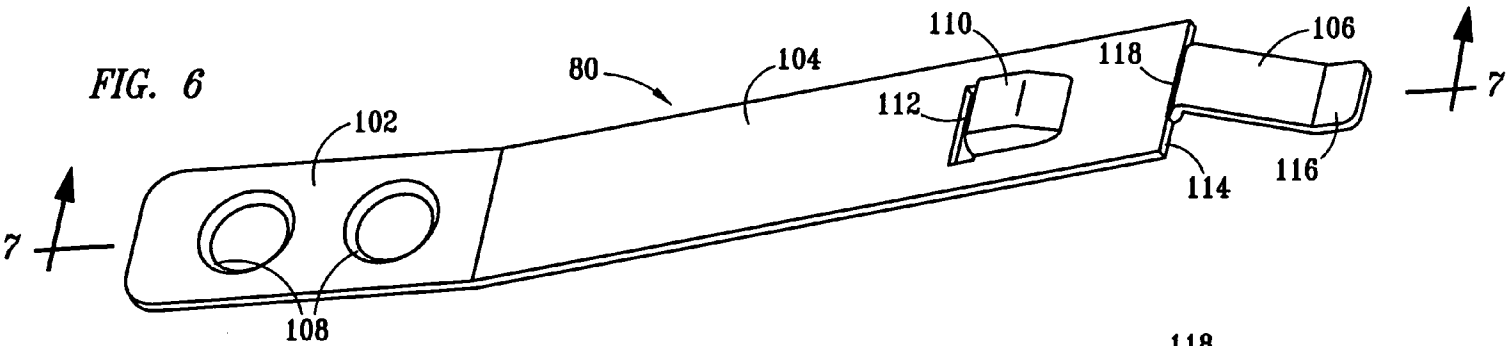
Figure 7:
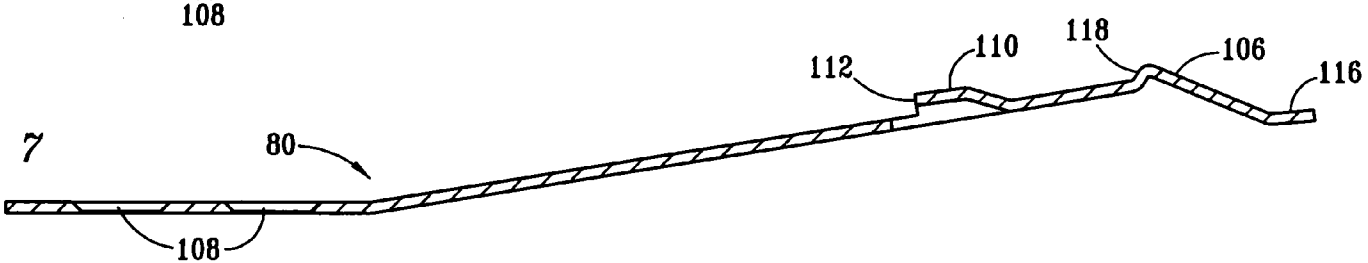

FIG. 6 is a perspective view of the lock member 80, and FIG. 7 is a longitudinal section view of the lock member 80, taken along section line 7—7 of FIG. 6. The lock member 80 is preferably provided by an elongated, flat strip of spring steel, having a rectangular shape with a forward portion 102, a central portion 104 and a tab 106. The tab 106 extends from a rearward end of the central portion 104. Mounting holes 108 are formed into the forward portion 102. An emboss 110 extends upward from the central portion 104, and has a forward facing edge which defines a shoulder 112. A rearwardly disposed edge of the central portion 104 defines a rearwardly facing shoulders 114 on opposite sides of the tab 106. The tab 106 is formed to extend from the rearward end of the central portion 104 with a width which is smaller than the width of the central portion 104 to define the shoulder 114. The opposite end of the tab 106 from the central portion 104 is formed to provide a foot 116. The foot 116 is provided by forming the terminal end of the tab 106 such that it extends at an obtuse angle to a main body portion of the tab 106 and substantially parallel to the planer surface of the web portion 30 of the chassis member 14. A forward end of the tab 106 which is adjacent to the central portion 104 of the lock member 80 has an arcuate surface 118 to aid in assembling and in passing the aperture 82 formed in the intermediate member 16 over the lock member 80.

Figure 8:
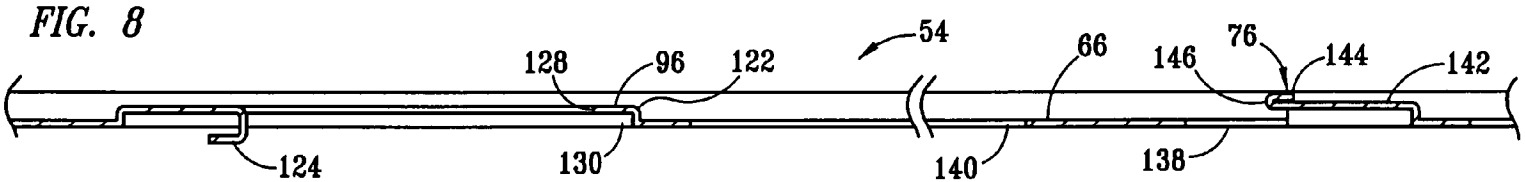

FIG. 8 is a partial, longitudinal section view of the front release member 66 which provides the front release 54. A longitudinally extending slot 178 is formed into the emboss 96. A rearward end 122 of the emboss 96 is enclosed, and is offset from a web portion of the release member 66. A forward end portion of the emboss section 96 is formed downward to provide a tab 124 for mounting a forward end of the spring bias spring 74 (shown in FIG. 5) to the front release member 66. The open region 130 is defined within the emboss 96, which will be disposed adjacent to the central web portion 30 of the chassis member 14. The bias spring 76 (shown in FIG. 5) will extend from the tab 124 in the front release member 66 to a tab 132 formed in the web portion 30 of the chassis member 14 (shown in FIG. 9). The window 138 is provided by an aperture disposed adjacent to the cam portion 76 of the front release member 66. A window 140 is disposed between the emboss 122 and the aperture 82, for passing the lock member 80 from the chassis member 14 through the front release member 66. The window 138 provides a passage for the tab portion 106 of the lock member 80 to extend through the front release member 66 and adjacent to the cam portion 76. The cam portion 76 is defined by an emboss 142 having a rearward terminal end 144 which is folded back and adjacent to the main surface of the emboss 142 to define a rounded edge 146. The emboss 142 captures the tab portion 106, with the tab portion 106 providing a foot which slides between the emboss 142 and the web portion 30 of the chassis member 14, captured between the emboss 142 and the web portion 30 of the chassis member 14.

Figure 9:
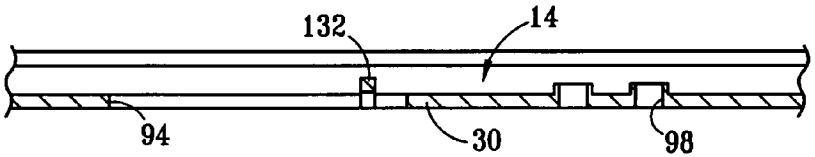

FIG. 9 is a partial longitudinal section view of the chassis member 14, showing the slot 94 which provides clearance for receiving these frame bias spring 74. The tab 132 extends upward from the chassis member 14, adjacent to a rearward end of portion of the slot 94. Mounting holes 98 are disposed through the web portion 30 of the chassis member 14.

Figure 10:
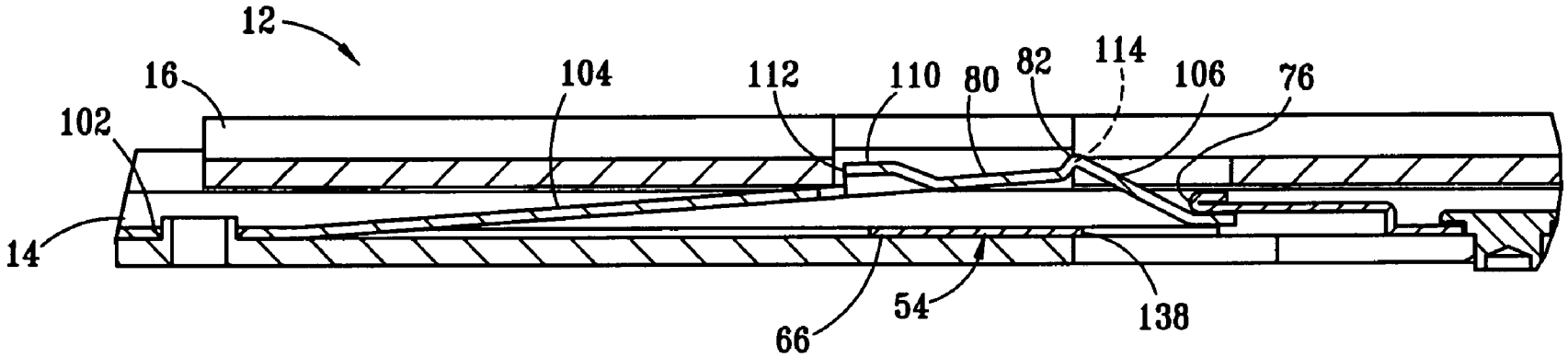
Figure 11:
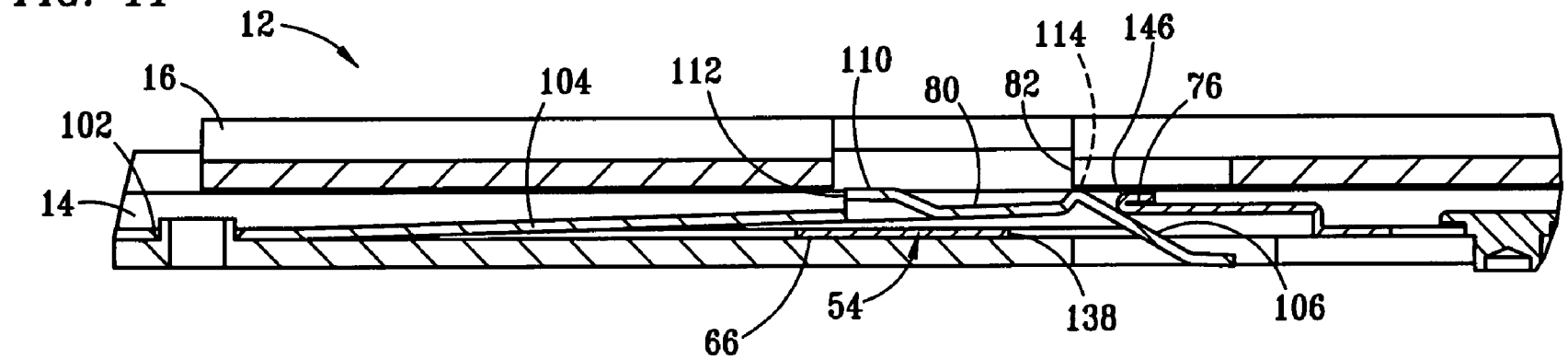

FIGS. 10 and 11 are partial longitudinal section views of the front portion of the drawer slide 12. FIG. 10 shows the lock 52 in a locked position, and FIG. 11 showing the lock 52 in a released position, with the front release 54 pulled forward. In FIG. 10, the lock member 80 is extending upward and into the aperture 82 of the intermediate member 16. The tab 106 extends adjacent to the window 138 in the front release member 66, and fits underneath the cam portion 76. The shoulder 112 of the embossed section 110 of the lock member 80 will engage against a forward edge 148 of the enlarged portion 152 of the aperture 82 of the intermediate member 16. The two shoulders 114 (shown in FIG. 6) will engage against the edge 148 defined by the rear edge 154 (shown in FIG. 5) of the enlarged portion 152 of the aperture 82 to lock the rack member 18 in fixed relation to the intermediate member 16. In FIG. 11, the forward release member 66 providing the forward release 54 has been pulled forward, pulling the forward edge 146 of the cam portion 76 against the tab 106 of the lock member 80, pushing the main body portion 104 of the lock member 80 downward, such that it rotates relative to the forward portion 102 which is fixed against the web portion 30 of the chassis member 14. Moving the lock member 80 downward moves the embossed section 110 and the shoulders 114 of the lock member 80 to move beneath the aperture 82, such that the chassis member 14 is free to move relative to the intermediate member 16.

Figure 12:
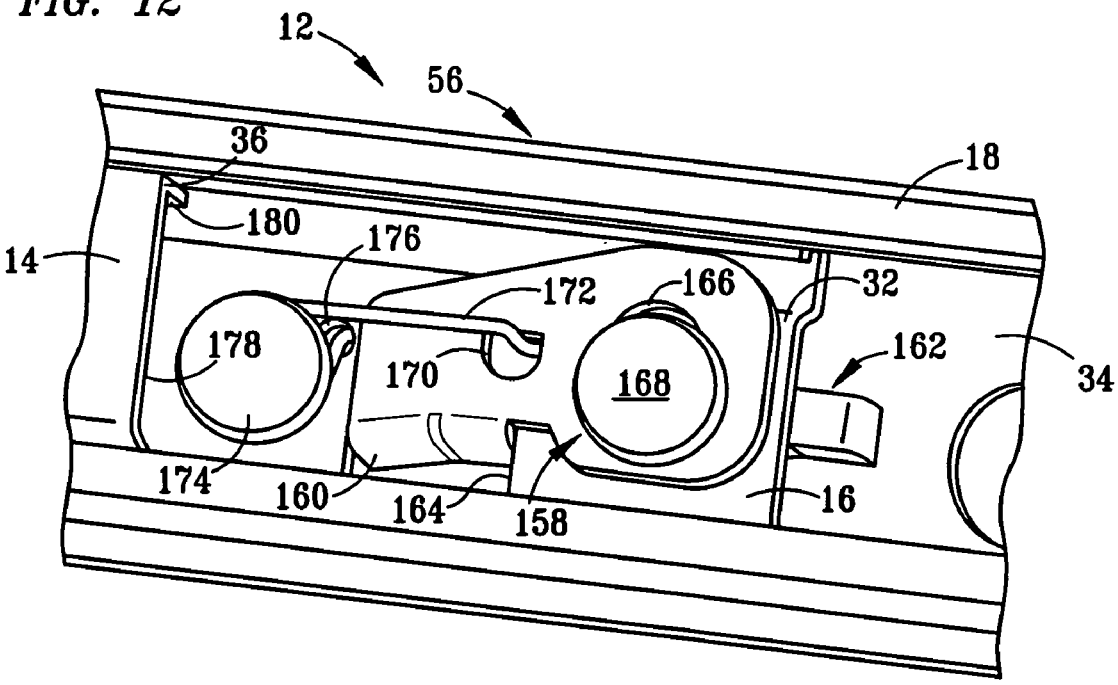
Figure 13:
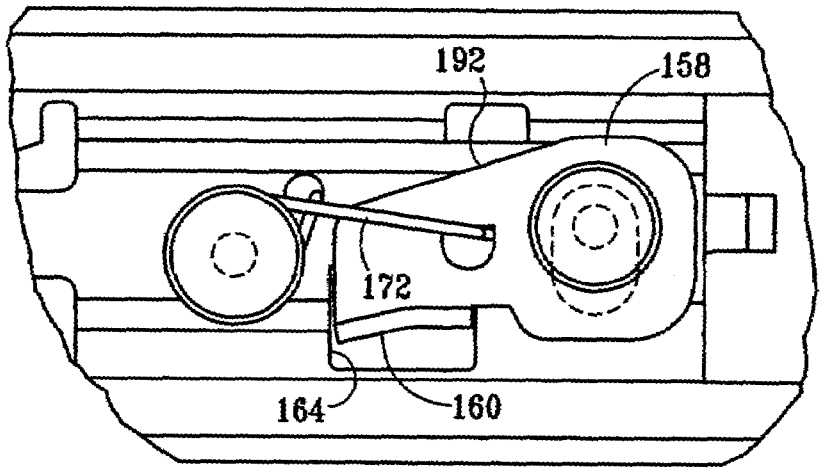

FIGS. 12 and 13 are partial perspective views of the rear lock 56 of the drawer slide 12, with FIG. 12 showing the rear lock 56 in a locked position and FIG. 13 showing the rear lock 56 in a released position. The rear lock 56 includes a lock member 158 having a tab 160 formed in a forward end thereof. The tab 160 extends transverse to the plane of a main body portion of the lock member 158, and transverse to the longitudinal axis 28 (shown in FIG. 1). The lock member 158 is secured to the rearward end of the intermediate member 16. An emboss 162 is formed on the web portion 34 of the rack member 18 to define a protuberance which extends from the rack member 18 toward the intermediate member 16. The tab 160 of the lock member 158 will engage the emboss 162 to latch the intermediate member 16 in a forward position relative to the rack member 34. An aperture provides a window 164 in the intermediate member 16, such that the tab 160 of the lock member 158 will protrude through the web portion 32 of the intermediate member 16 for engaging the protuberance defined by the emboss 162 of the intermediate portion 34 of the rack member 18. A slot 166 extends within the lock member 158 for receiving the fastener 168 which slidable secures the lock member 158 to the intermediate member 16. The slot 166 extends for a longer length than the width of the shank portion of the fastener 168 which extends through the lock member 158, such that the lock member 158 may move lineally relative to the intermediate member 16, in upwards and downwards directions. The window 164 extends into a central web 32 portion of the intermediate member 16, with a profile providing a guide, or guide slot, such that the tab 160 of the lock member 158 will slide lineally with the same respective travel as the slot 166 slides over the fastener 168.

An aperture of 170 is provided in the lock member 158 for receiving one end of a torsion spring 172. Mounting fastener 174 secures the torsion spring 172 to the web portion 32 of intermediate member 16, and a second aperture 176 provides a mounting hole for a second end of the torsion spring 172. The torsion spring 172 will push the lock member 158 into an upward position relative to the intermediate member 16, with the fastener 168 disposed in the lower portion of the slot 166, and the tab 160 will extend into an upper portion of the window 164. Profile 178 of the chassis member 14 defines an edge 180 (shown in FIG. 2) which, as the chassis member 14 is moved rearward relative to the rearward end of the intermediate member 16, will engage a cam follower surface 192 of the lock member 158, pushing the lock member 158 linearly downward with the tab 168 sliding within the guide, or guide slot, provided by the window 164 and the window 166 sliding downward over the fastener 168, such that the lock member 158 will lineally move in a downward direction until the tab 160 is aside of the protuberance defined by the emboss 162 of the rack member 18.

Figure 14:
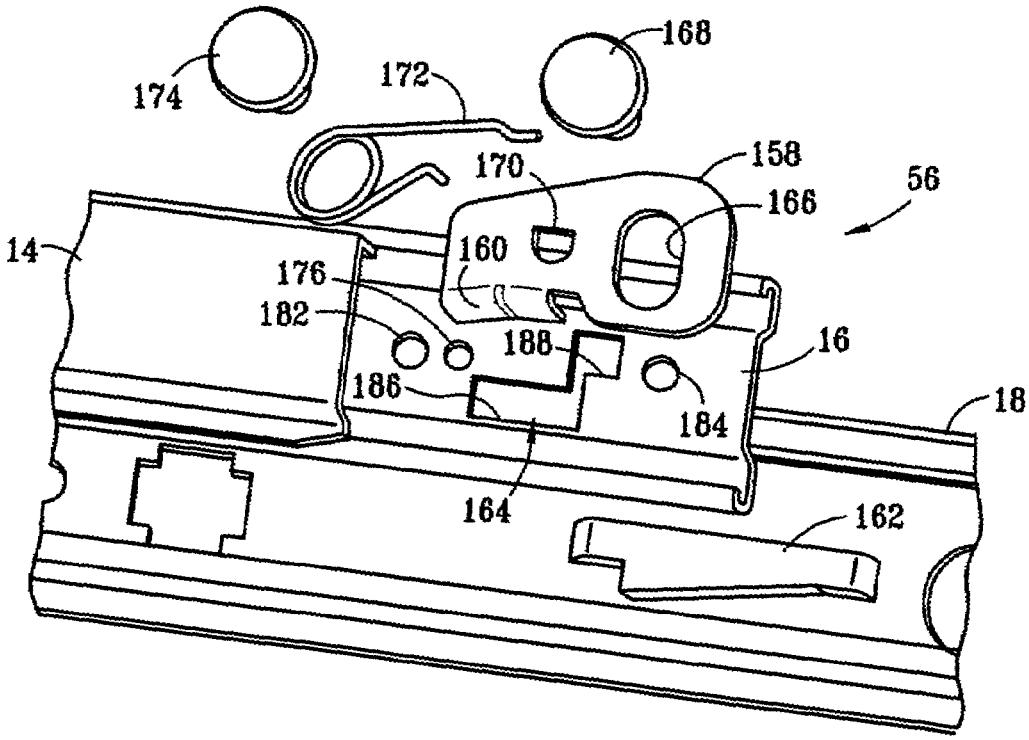

FIG. 14 is a partial exploded view of a rearward portion of drawer slide 12, showing various components of rear lock 56. The mounting holes 182 and 184 are provided for mounting respective ones of the fasteners 174 and 176 to secure the torsion spring 172 and the lock member 158 to the intermediate member 16 in operative relation. The window 164 has an enlarged portion 186 which is provided for slidably receiving the tab 60 of the lock member 158, and a smaller portion 188 which provides clearance for the first end of the torsion spring 172. The torsion spring 172 extends through the aperture of 170 and into the smaller portion 188 of the window 164.

Figure 15:
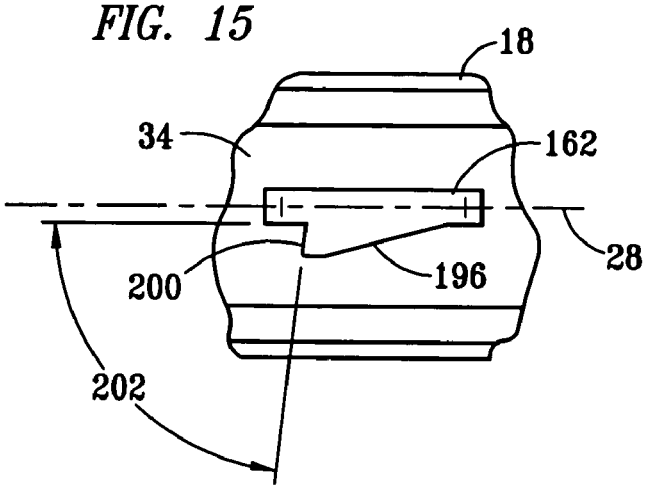

FIG. 15 is a partial side view of the rack member 18 of drawer slide 12, showing the protuberance defined by the embossed portion 162 of the centrally disposed, web portion 34 of the rack member 18. A cam surface 196 is defined to extend at an angle to the longitudinal axis 28, and a forward facing shoulder 200 is defined to extend adjacent to the cam portion 196 of the emboss 162. The shoulder 200 extends at an angle 202 to the longitudinal axis 28, such that the torsion spring when pushing the lock member upwards, will cause the tab 160 to lodge upwards in the upward portion of the shoulder 200 of the emboss 162.

Figure 16:
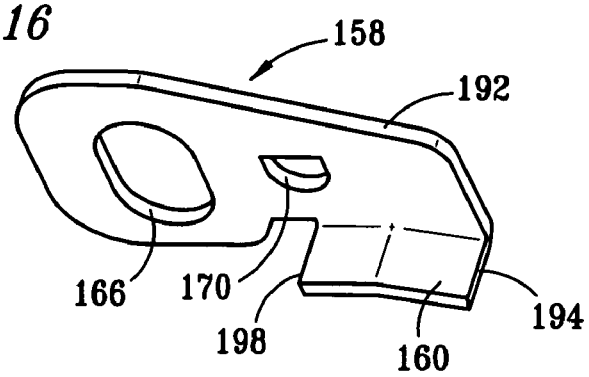

FIG. 16 is a perspective view of the lock member 158 of the rear lock 56. Lock member 158 is shown having the tab 160 with a forward shoulder 194, a rearward facing shoulder 198. Slot 166 and aperture 170 extend through a main body portion of the lock member 158.

Figure 17:
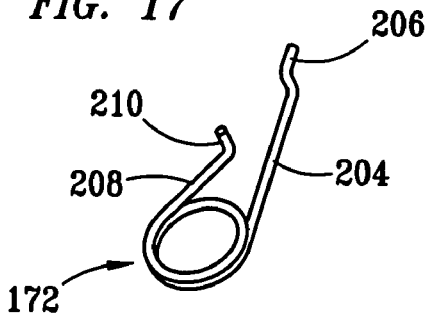

FIG. 17 is a perspective view of the torsion spring 172, showing arms 204 and 208, with arm 204 having a tab 206 and arm 208 having a tab 210. The tab 210 extends at a right angle to the axis of the arm 208. A terminal end of the arm 204 has a joggle which extends parallel to the main arm portion 204, at a slight displacement thereto. The tab 206 will fit through the aperture 170 in the lock member 158 and in the aperture 188 in the web portion 32 of the intermediate member 16.

Drawer slides made according to the present invention may be used in various types of applications, such as racks and cabinets for computers, telecommunication servers, other electronic equipment, and also for general furniture. The terms "chassis" and "cabinet" as used in the present Specification, including the following Claims, refers to each of the various types of applications in which the drawer slides of the present invention may be used, and includes drawers and shelves which are installed into various types of racks or cabinets, with or without enclosure panels being installed on the racks and cabinets.

The present invention provides several advantages over prior art drawer slides. A forward lock member is provided having a low profile with a lock member provided from a spring type material, which is displaced from engaging within a window of an intermediate member by a cam member defined adjacent to an aperture extending into a forward release member, which when pulled forward will urge the lock member aside of the window in the intermediate member and towards the chassis member. A rear lock is provided by a lock member which is lineally moved at a transverse angle to the longitudinal axis of the drawer slide. Rearward movement of the chassis member over the lock member of the rear lock will urge the lock member upward in a lineal direction, along a substantially straight line, with a slot of the lock member moving over a shank of a fastener and a tab of the lock member moving lineally with a guide provided by a window formed into the intermediate member, such that the tab is moved lineally side of a shoulder of an emboss form on the right member. Drawer slides having locks made according to the present invention provide a lower profile, that is a thinner drawer slide, than locks provided for prior art drawer slides.

Although the preferred embodiment has been described in detail, it should be understood that various changes, substitutions and alterations can be made therein without departing from the spirit and scope of the invention as defined by the appended claims.

What is claimed is:

1. A drawer slide comprising:

a chassis member having a chassis member web portion and chassis member edge portions;

an intermediate member having an intermediate member web portion and intermediate member edge portions;

a rack member having a rack member web portion and rack member edge portions;

wherein said intermediate member is telescopically extensible from within said rack member and said chassis member is telescopically extensible from within said intermediate member, with said chassis member web portion, said intermediate member web portion and said rack member web portion extending substantially parallel to a longitudinal axis of said drawer slide, and said chassis member edge portions, said intermediate member edge portions and said rack member edge portions disposed in parallel alignment;

a protuberance extending from said rack member toward said intermediate member;

a lock member slidably mounted to said intermediate member, said lock member having a tab formed to extend transverse to said longitudinal axis of said drawer slide;

a window formed into said intermediate web portion for receiving said tab of said lock member, such that said tab protrudes through said intermediate member web portion for engaging said protuberance extending from said rack member;

a torsion spring mounted to said intermediate member;

wherein said lock member is biased to move into a first position by said torsion spring, disposed for engaging said protuberance when said intermediate member is disposed in a forward position relative to said rack member; and wherein said chassis member engages said lock member and lineally moves said lock member to a second position, with said tab disposed aside of said protuberance extending from said rack member.

2. The drawer slide according to claim 1, wherein said protuberance is defined by an emboss formed into said rack member web portion.

3. The drawer slide according to claim 1, wherein said lock member has a slot and an aperture formed therein, spaced apart and extend through a main body portion of said lock member, said slot extending transverse to said tab for receiving a fastener which slidably secures said lock member to said intermediate member, wherein said slot has a length which is longer than a width of a shank portion of said fastener such that said lock member may move lineally relative to said intermediate member, in upwards and downwards directions.

4. The drawer slide according to claim 3, wherein said window has edges for slidably receiving opposite edges of said tab and extending in parallel with said slot, such that said tab will lineally slide within said window and said fastener will lineally slide within said slot with said lock member moving lineally upward and downward relative to said drawer slide.

5. The drawer rawer according to claim 1, wherein said drawer slide further comprises:

two mounting holes formed into said intermediate member web portion, spaced apart on opposite sides of said window, wherein two fasteners are secured in respective ones of said two mounting holes and extending through said torsion spring and a slot formed in said lock member, respectively; and said intermediate member further having a third mounting hole for receiving a first terminal end of said torsion spring which defines a first tab.

6. The drawer slide according to claim 5, wherein said torsion spring comprises a first arm and a second arm, with said second arm having a second terminal end which defines a second tab and said first arm having said first terminal end which defines said first tab, said first tab extending at a right angle to an axis of said first arm and a terminal end of said second arm having a joggle which extends parallel to a main arm portion of said second arm, wherein said second tab fits through an aperture in said lock member.

7. The drawer slide according to claim 6, wherein said window comprises an enlarged portion which is provided for slidably receiving said tab of said lock member, and a smaller portion which provides clearance for said second tab of said torsion spring, such that said second tab of said torsion spring extends through said aperture of said lock member and into said smaller portion of said window.

8. The drawer slide of claim 1, further comprising:

a catch aperture formed into said intermediate member web portion;

a front lock member having a first portion, a second portion and a third portion, said first portion secured to said chassis member web portion, said second portion extending from said first portion, away from said chassis member and toward said intermediate member, with at least a portion of said second portion extending into said catch aperture, and said third portion extending from said second portion, away from said intermediate member and toward said chassis member; and a release member slidably secured to said chassis member, said release member having a release member window and a cam portion, said release member window disposed for receiving said third portion of said front lock member and said cam portion disposed adjacent to said release member window for pulling in a first direction to engage said third portion of said front lock member and withdraw said second portion of said front lock member from within said catch aperture.

9. In a drawer slide having a chassis member which includes a chassis member web portion and chassis member edge portions, an intermediate member which includes an intermediate member web portion and intermediate member edge portions, and a rack member which includes a rack member web portion and rack member edge portions, wherein said intermediate member is telescopically extensible from within said rack member and said chassis member is telescopically extensible from within said intermediate member, with chassis member web portion, said intermediate member web portion and said rack member web portion extending substantially parallel to a longitudinal axis of said drawer slide, and said chassis member edge portions, said intermediate member edge portions and said rack member edge portions disposed in parallel alignment, the improvement comprising:

a protuberance extending from said rack member web portion toward said intermediate member;

a lock member slidably mounted to said intermediate member, said lock member having a tab formed to extend transverse to the longitudinal axis of said drawer slide, a window formed into said intermediate member web portion for receiving said tab of said lock member, such that said tab protrudes through said intermediate member web portion for engaging said protuberance extending from said rack member;

a torsion spring secured to said intermediate member and engaging said lock member to move said lock member into a first position, disposed for engaging said protuberance when said intermediate member is disposed in a forward position relative to said rack member; and wherein said chassis member has a profile, such that as the chassis member is moved rearward relative to said intermediate member, said profile engages said lock member and lineally moves said lock member to a second position, with said tab disposed aside of said protuberance extending from said rack member.

10. The drawer slide according to claim 9, wherein said protuberance is defined by an emboss formed into said rack member web portion.

11. The drawer slide according to claim 9, wherein said lock member has a slot and an aperture formed therein, spaced apart and extend through a main body portion of said lock member, said slot extending transverse to said tab for receiving a fastener which slidably secures said lock member to said intermediate member, wherein said slot has a length which is longer than a width of a shank portion of said fastener such that said lock member may move lineally relative to said intermediate member, in upwards and downwards directions, and said window having edges for slidably receiving opposite edges of said tab and extending in parallel with said slot, such that said tab will lineally slide within said window and said fastener will lineally slide within said slot with said lock member moving lineally upward and downward relative to said drawer slide.

12. The drawer rawer slide according to claim 9, further comprising:

two mounting holes formed into said intermediate member web portion, spaced apart on opposite sides of said window, wherein two fasteners are secured in respective ones of said two mounting holes and extending through said torsion spring and a slot in said lock member, respectively; and said intermediate member further having a third mounting hole for receiving a first terminal end of said torsion spring which defines a first tab.

13. The drawer slide according to claim 12, wherein said torsion spring comprises a first arm and a second arm, with said second arm having a second terminal end which defines a second tab and said first arm having said first terminal end which defines said first tab, said first tab extending at a right angle to an axis of said first arm and second terminal end of said second arm having a joggle which extends parallel to a main arm portion of said second arm, wherein said second tab fits through an aperture in said lock member.

14. The drawer slide according to claim 13, wherein said window comprises an enlarged portion which is provided for slidably receiving said tab of said lock member, and a smaller portion which provides clearance for said second tab of said torsion spring, such that said second tab of said torsion spring extends through said aperture of said lock member and into said smaller portion of said window.

15. The drawer slide of claim 9, further comprising:

a catch aperture formed into said intermediate member web portion;

a front lock member having a first portion, a second portion and a third portion, said first portion secured to said chassis member web portion, said second portion extending from said first portion, away from said chassis member and toward said intermediate member, with at least a portion of said second portion extending into said catch aperture, and said third portion extending from said second portion, away from said intermediate member and toward said chassis member; and a release member slidably secured to said chassis member, said release member having a release member window and a cam portion, said release member window disposed for receiving said third portion of said front lock member and said cam portion disposed adjacent to said release member window for pulling in a first direction to engage said third portion of said front lock member and withdraw said second portion of said front lock member from within said catch aperture.

16. A drawer slide comprising:

a chassis member having a chassis member web portion and chassis member edge portions;

an intermediate member having an intermediate member web portion and intermediate member edge portions, a rack member having a rack member web portion and rack member edge portions;

wherein said intermediate member is telescopically extensible from within said rack member and said chassis member is telescopically extensible from within said intermediate member, with chassis member web portion, said intermediate member web portion and said rack member web portion extending substantially parallel to a longitudinal axis of said drawer slide, and said chassis member edge portions, said intermediate member edge portions and said rack member edge portions disposed in parallel alignment;

an emboss formed into said rack member web portion to define a protuberance which extends from said rack member web portion toward said intermediate member, said emboss defining a cam surface which extends at an angle to said longitudinal axis of said drawer slide and defining a forward facing shoulder which extends adjacent to said cam surface of said emboss at an angle to said longitudinal axis of said drawer slide;

a lock member having a main body portion and a tab formed in a lower end thereof; said tab extending transverse to a plane of said main body portion of said lock member and transverse to said longitudinal axis of said drawer slide, said tab having a forward shoulder and a rearward facing shoulder, and said lock member having an edge disposed on an opposite side of said lock member from said tab to define a cam follower surface;

said lock member further having a slot and an aperture which are spaced apart and extend through said main body portion of said lock member, said slot extending transverse to said tab for receiving a fastener which slidably secures said lock member to said intermediate member, wherein said slot has a length which is longer than a width of a shank portion of said fastener such that said lock member may move lineally relative to said intermediate member, in upwards and downwards directions;

a window formed into said intermediate web portion for receiving said tab of said lock member, such that said tab protrudes through said intermediate member web portion for engaging said emboss of said rack member web portion, said window having edges for slidably receiving opposite edges of said tab and extending in parallel with said slot, such that said tab will lineally slide within said window and said fastener will lineally slide within said slot with said lock member moving lineally upward and downward relative to said drawer slide;

a torsion spring secured to said intermediate member and engaging within said aperture in said lock member to push said lock member into an upward position, relative to said intermediate member, with said fastener disposed in a lower portion of said slot and said tab extending through an upper portion of said window, such that said tab is disposed for engaging said forward facing shoulder of said emboss when said intermediate member is disposed in a forward position relative to said rack member; and wherein at least one of said chassis member web portion and said chassis member edges defines a chassis member profile, such that as said chassis member is moved rearward relative to said rearward end of said intermediate member, said profile engages said cam follower surface of said lock member, pushing said lock member linearly downward with said tab sliding within said window and said slot sliding downward over said fastener, such that said lock member will linearly move in a downward direction until said tab is aside of said emboss of said rack member.

17. The drawer rawer slide according to claim 16, further comprising:

two mounting holes formed into said intermediate member web portion, spaced apart on opposite sides of said window, wherein two fasteners are secured in respective ones of said two mounting holes and extending through said torsion spring and said slot in said lock member, respectively; and said intermediate member further having a third mounting hole for receiving a first terminal end of said torsion spring which defines a first tab.

18. The drawer slide according to claim 17, wherein said torsion spring comprises a first arm and a second arm, with said second arm having a second terminal end which defines a second tab and said first arm having said first terminal end which defines said first tab, said first tab extending at a right angle to an axis of said first arm and said second terminal end of said second arm having a joggle which extends parallel to a main arm portion of said second arm, wherein said second tab fits through an aperture in said lock member.

19. The drawer slide according to claim 18, wherein said window comprises an enlarged portion which is provided for slidably receiving said tab of said lock member, and a smaller portion which provides clearance for said second tab of said torsion spring, such that said second tab of said torsion spring extends through said aperture of said lock member and into said smaller portion of said window.

20. The drawer slide of claim 16, further comprising:

a catch aperture formed into said intermediate member web portion;

a front lock member having a first portion, a second portion and a third portion, said first portion secured to said chassis member web portion, said second portion extending from said first portion, away from said chassis member and toward said intermediate member, with at least a portion of said second portion extending into said catch aperture, and said third portion extending from said second portion, away from said intermediate member and toward said chassis member; and a release member slidably secured to said chassis member, said release member having a release member window and a cam portion, said release member window disposed for receiving said third portion of said front lock member and said cam portion disposed adjacent to said release member window for pulling in a first direction to engage said third portion of said front lock member and withdraw said second portion of said front lock member from within said catch aperture.

* * * * *